US009315244B2

(12) United States Patent
Kalkman et al.

(10) Patent No.: US 9,315,244 B2
(45) Date of Patent: Apr. 19, 2016

(54) HOLD CRANE AS WELL AS PIPEFEEDER VESSEL WITH SUCH HOLD CRANE

(75) Inventors: Pieter Kalkman, Waddinxveen (NL); Hans Wouter Valk, Huizen (NL); Hendrik Alblas, Burgh-Haamstede (NL)

(73) Assignees: P. KALKMAN WADDINXVEEN BEHEER B.V., Waddinxveen (NL); SPLIETHOFF'S BEVRACHTINGSKANTOOR B.V., Amsterdam (NL)

( * ) Notice: Subject to any disclaimer, the term of this patent is extended or adjusted under 35 U.S.C. 154(b) by 0 days.

(21) Appl. No.: 13/556,691

(22) Filed: Jul. 24, 2012

(65) Prior Publication Data

US 2013/0284081 A1 Oct. 31, 2013

(30) Foreign Application Priority Data

Jul. 26, 2011 (EP) ..... 11175364

(51) Int. Cl.
*B66C 13/06* (2006.01)
*B63B 27/12* (2006.01)
*B63B 35/03* (2006.01)

(52) U.S. Cl.
CPC ..... *B63B 27/12* (2013.01); *B63B 35/03* (2013.01); *B66C 13/06* (2013.01)

(58) Field of Classification Search
CPC ..... B66C 13/00; B66C 13/06; B66C 19/00; B63B 27/12; B63B 27/36
USPC ..... 212/77, 81, 88–89, 98, 328, 333, 346
See application file for complete search history.

(56) References Cited

U.S. PATENT DOCUMENTS

| | | | | | |
|---|---|---|---|---|---|
| 164,643 | A | * | 6/1875 | Force, Jr. | 212/327 |
| 710,920 | A | * | 10/1902 | Morgan | 212/333 |
| 1,736,016 | A | * | 11/1929 | Rosener | 294/106 |
| 1,834,499 | A | * | 12/1931 | Richter | B66C 1/22 294/192 |
| 1,867,450 | A | * | 7/1932 | Genzmer | 212/77 |

(Continued)

FOREIGN PATENT DOCUMENTS

| | | | |
|---|---|---|---|
| FR | 2 430 387 | A1 | 2/1980 |
| GB | 1 208 857 | A | 10/1970 |

OTHER PUBLICATIONS

European Search Report, dated Dec. 29, 2011, from corresponding Europe application.

*Primary Examiner* — Emmanuel M Marcelo
*Assistant Examiner* — Michael Gallion
(74) *Attorney, Agent, or Firm* — Young & Thompson

(57) ABSTRACT

A hold crane (6) for elongate elements (4), such as a pipe hold crane for a pipefeeder vessel (1), includes a main frame (7) and support elements (9-12) supporting the main frame above a hold which is carried out for containing the elongate elements. The support elements allow displacement of the main frame in a longitudinal direction of the hold. Hoisting members are provided which are carried by the main frame for lifting an elongate element from the hold vice versa, the hoisting members including at least two hoisting elements spaced apart in the longitudinal direction of the hold. The hoisting elements are suspended from the main frame and are provided coupling elements for coupling onto an elongate element. Stabilizing elements, which cooperate with the hoisting elements, prevent movement of the coupling elements in transverse direction with respect to the main frame while allowing vertical movement of the coupling elements.

9 Claims, 5 Drawing Sheets

(56) References Cited

U.S. PATENT DOCUMENTS

| | | | | | |
|---|---|---|---|---|---|
| 3,024,058 | A | * | 3/1962 | Sinclair | 294/87.1 |
| 3,308,966 | A | * | 3/1967 | Fawell | 212/274 |
| 3,428,194 | A | * | 2/1969 | Weiss | 414/142.6 |
| 3,536,204 | A | * | 10/1970 | Auzins | 212/307 |
| 3,552,344 | A | * | 1/1971 | Wilson | 114/260 |
| 3,661,279 | A | | 5/1972 | Macrander | |
| 3,746,182 | A | * | 7/1973 | Tax et al. | 212/274 |
| 3,750,811 | A | * | 8/1973 | Anderson et al. | 414/460 |
| 3,786,936 | A | * | 1/1974 | Staadt | 212/291 |
| 4,094,493 | A | * | 6/1978 | Polen | 254/285 |
| 4,136,633 | A | * | 1/1979 | Homer | E21B 19/002 114/264 |
| 4,214,664 | A | * | 7/1980 | Polen | 212/274 |
| 4,336,962 | A | * | 6/1982 | Read | 294/106 |
| 4,492,310 | A | * | 1/1985 | Weingart | 212/308 |
| 4,563,031 | A | * | 1/1986 | Kishimoto et al. | 294/81.21 |
| 5,074,528 | A | * | 12/1991 | Long, Jr. | 254/285 |
| 5,445,426 | A | * | 8/1995 | Sorensen | 294/67.3 |
| 5,480,201 | A | * | 1/1996 | Mercer | 294/67.31 |
| 5,522,633 | A | * | 6/1996 | Massi | 294/81.52 |
| 5,562,394 | A | * | 10/1996 | Brown, Jr. | 414/626 |
| 6,827,334 | B2 | * | 12/2004 | Volle et al. | 254/285 |
| 7,150,366 | B1 | * | 12/2006 | Zakula, Sr. | B66C 13/06 212/272 |
| 7,284,744 | B1 | * | 10/2007 | Lerchenmueller et al. | 254/278 |
| 7,845,296 | B1 | * | 12/2010 | Khachaturian | B63B 1/121 114/50 |

* cited by examiner

HOLD CRANE AS WELL AS PIPEFEEDER VESSEL WITH SUCH HOLD CRANE

BACKGROUND OF THE INVENTION

The invention is related to a hold crane for elongate elements, such as a pipe hold crane for a pipefeeder vessel, comprising a main frame, support means supporting the main frame above a hold which is carried out for containing the elongate elements, said support means allowing displacement of the main frame in longitudinal direction of the hold, and hoisting means carried by the frame for lifting an elongate element from the hold, said hoisting means comprising at least two hoisting elements, such as cables, which are spaced apart in the longitudinal direction of the hold, said hoisting elements, such as cables, each being suspended from the main frame and being provided coupling means, such as a hook, for coupling onto an elongate element.

DESCRIPTION OF THE RELATED ART

A hold crane of this type is usually present in pipe feed vessels which are employed for the transport of pipes to a pipe laying vessel. Onboard the pipe laying vessel, the pipes are welded together and laid on the sea bottom from the pipe laying vessel. Specifically, the construction of pipelines for hydrocarbons such as natural gas or oil is carried out in this way. Having regard to the fact that the pipeline is laid on the sea bottom, the pipes are coated with a protective layer in the form of a concrete coating. This coating provides a protection against corrosion, and furthermore serves the purpose of adding mass to the pipeline for preventing the effect of floating up in the sea water.

At regular intervals, the stock of pipes which is present in the pipe laying vessel must be replenished so as to ensure an efficient pipe laying process. As mentioned before, this is done by means of pipefeeder vessels. The pipefeeder vessels are loaded onshore, and are subsequently unloaded at sea by the hoisting cranes of the pipe laying vessel. To that end, the pipes in question have to be retrieved from the pipefeeder vessel pipe hold and be presented so as to be picked up by said hoisting cranes for transfer to the pipe laying vessel. In this connection, personnel should enter the pipe hold and connect the pipes one by one to the coupling means onboard the pipefeeder vessel. This is a cumbersome and dangerous job. The pipes in question, in particular the ones which are coated with concrete, are heavy objects which are difficult to handle. Moreover, the unloading process takes place at sea, which brings the risk of unexpected movements of the pipe which furthermore complicate the unloading process and which may lead to costly delays.

SUMMARY OF THE INVENTION

The object of the invention is therefore to provide a pipe hold crane which allows a more efficient unloading process and which reduces the risk for the personnel involved in this process. This object is achieved by providing stabilizing means which cooperate with the hoisting elements, such as cables, and which prevent movement of the coupling means in transverse direction with respect to the main frame while allowing vertical movement of said coupling means.

The stabilizing means provide a better control of the hoisting process, in that the transverse movements of the coupling means are largely prevented. This allows a more predictable and thus safer behavior of the hold crane. Any personnel involved will run much less risk, even in case unexpected movements such as sway occur. Moreover, the controlled behavior of the hold crane offers the possibility to automate the unloading (and loading) process to a large degree, to such an extent that no personnel may have to enter the pipe hold.

The stabilizing means may be carried out in different ways. According to a preferred embodiment, the hoisting means may comprise at least three hoisting cables which are spaced in transverse direction with respect to each other, the stabilizing means comprising an auxiliary frame which is suspended below the main frame by said at least three hoisting cables and which is equipped with guide elements for guiding the auxiliary frame in height direction with respect to at least one of the inner boundaries of the hold, said auxiliary frame supporting the coupling means.

The auxiliary frame is stabilized against any undesired and/or uncontrolled transverse displacements. The side walls of the hold serve the purpose of maintaining the transverse position of the auxiliary frame; for instance the auxiliary frame may comprise rollers or wheels which roll over the vertically oriented walls of the cargo hold. For a stable suspension of the auxiliary frame, preferably the hoisting means comprise two pairs of hoisting cables, said pairs being spaced in transverse direction and the auxiliary frame being is suspended below the main frame by said at two pairs of hoisting cables.

The coupling means can now be positioned exactly with respect to the pipes etc. which have to be picked from the hold. The coupling means are preferably carried by at least one spreader beam extending in longitudinal direction of the hold, said spreader beam being displaceably supported in transverse direction with respect to the auxiliary frame. Thus, the coupling means may be positioned at any location within the cargo hold so as to handle pipes at any location therein. Preferably, the coupling means comprise hooks which are located at the opposite ends of the spreader beam.

The displacement of the spreader beam may be carried out in several ways. Preferably, the auxiliary frame carries transversely oriented support tracks, such as I-beams, and the spreader beam may have carriages equipped with rollers which are supported by said support tracks. With the aim of obtaining a high efficiency of the (un)loading process, the auxiliary frame may carry at least two parallel spreader beams. Furthermore, the support means provide for a height adjustment of the main frame. This makes it possible to transfer the main frame between an operative position and a rest position.

Actuating means may be provided for displacing the guide elements transversely with respect to the direction of displacement of the main frame as allowed by the displacement means. The guide elements may thus de displaced between an extended or operative position in contact with the longitudinal hold walls, and an inoperative position at a distance from said hold walls. In the latter inoperative position, the main frame can be displaced in the longitudinal direction of the hold.

As mentioned before, the stabilizing means may be carried out with an auxiliary frame supported against the walls of the cargo hold. According to another option, the hoisting means and stabilizing means comprise scissor arms which are suspended from the main frame, the lower ends of said scissor arms carrying a spreader beam provided with the coupling means. Such scissor arms, which are extendable and retractable in vertical direction with respect to the main frame, are mounted in such a way on the main frame that transverse displacements thereof are prevented. Furthermore, the scissor arms may mounted on a carriage which is transversely displaceable with respect to the main frame.

According to yet a further alternative option, the hoisting means and stabilizing means may comprise vertically extending arms, said arms being supported by the main frame and being displaceable in vertical direction, the lower ends of said arms carrying a spreader arm provided with the coupling means. Such arms may cooperate with the main frame through a vertical guide structure which prevents transverse movements and/or transverse rotations. The vertically extending arms may be mounted on a carriage which is transversely displaceable with respect to the main frame.

The invention is furthermore related to a pipe vessel, comprising a hull and a hold for containing pipes, as well as pipe hold crane as described before, wherein support tracks are provided which are oriented according to the longitudinal direction of a pair of opposite side walls of the pipe hold, the support means of the hold crane being displaceable along said support tracks. The support means may comprise a set of support tracks bordering the side walls of the pair of side walls, as well as rollers mounted on the main frame which are displaceably supported with respect to the support tracks.

BRIEF DESCRIPTION OF THE DRAWING FIGURES

The invention will now be described further with respect to the embodiment shown in the drawings.

Figure 2:
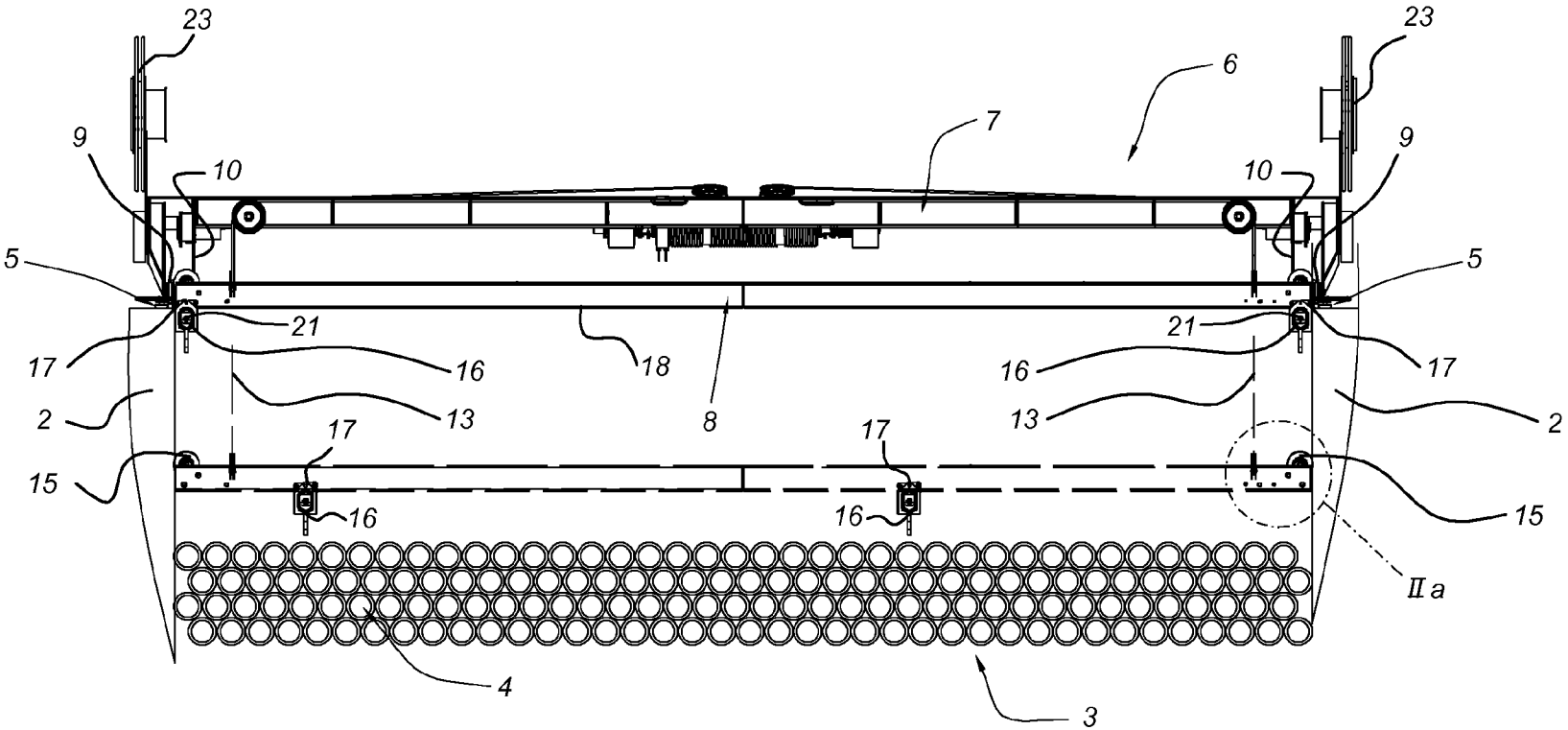
FIG. 2 shows a cross-sectional view of the pipefeeder vessel and front view of the hold crane.
Figure 2A:
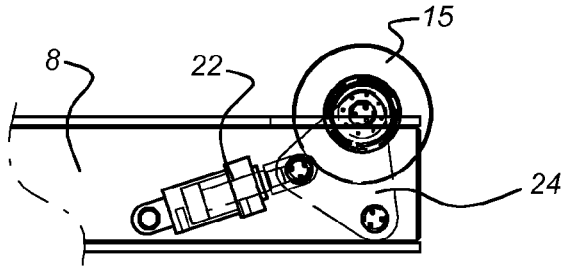

FIG. 2*a* shows detail IIa of FIG. 2

Figure 1:
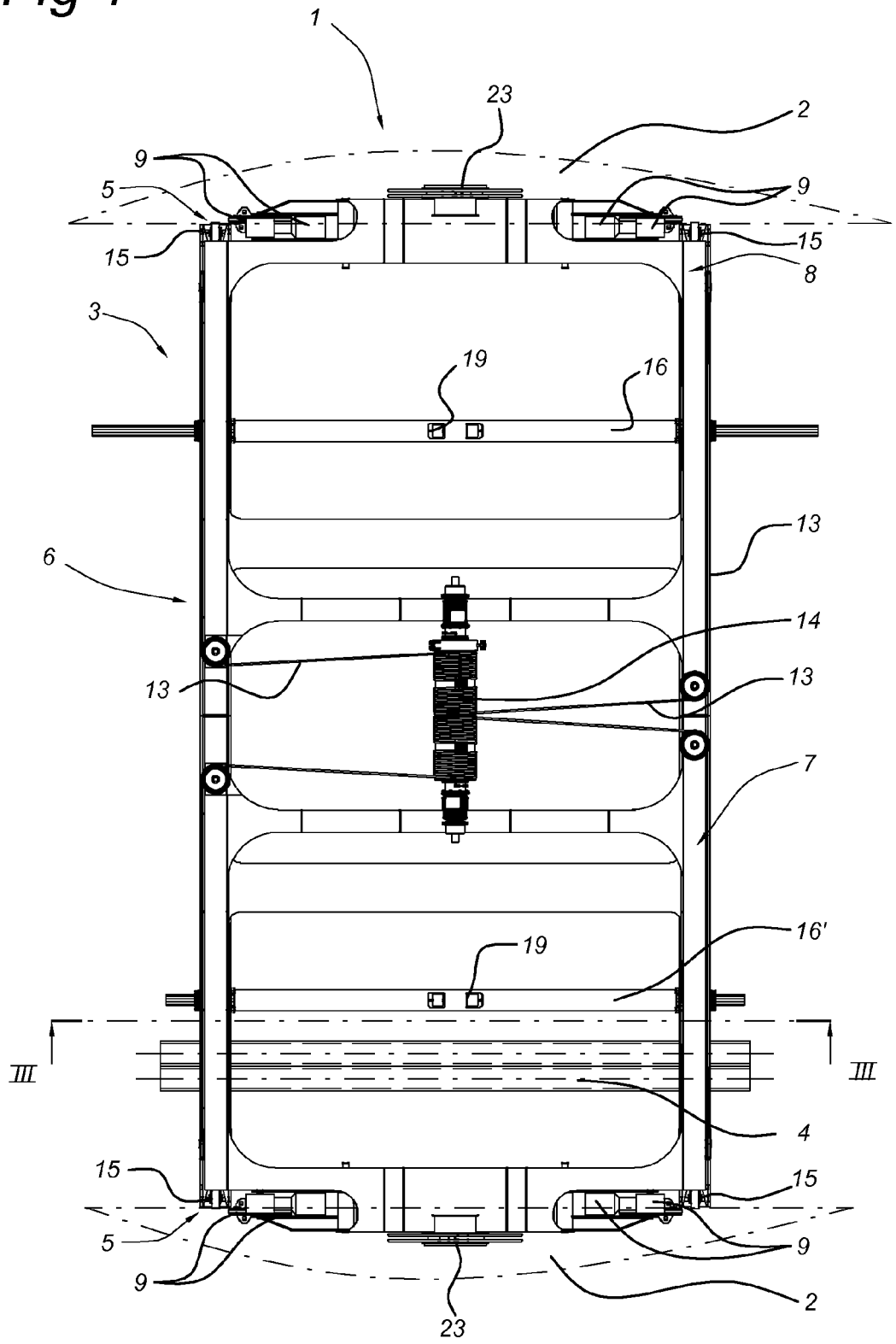
FIG. 1 shows a top view of part of a pipefeeder vessel with hold crane.
Figure 3:
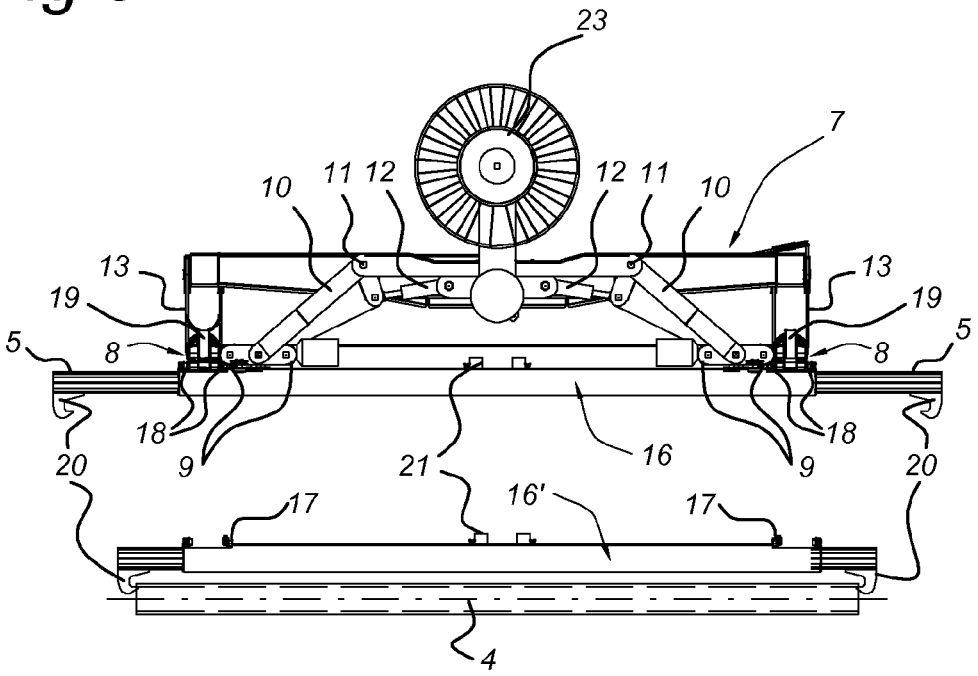

FIG. 3 shows a cross-sectional view according to III-III of FIG. 1.

Figure 4:
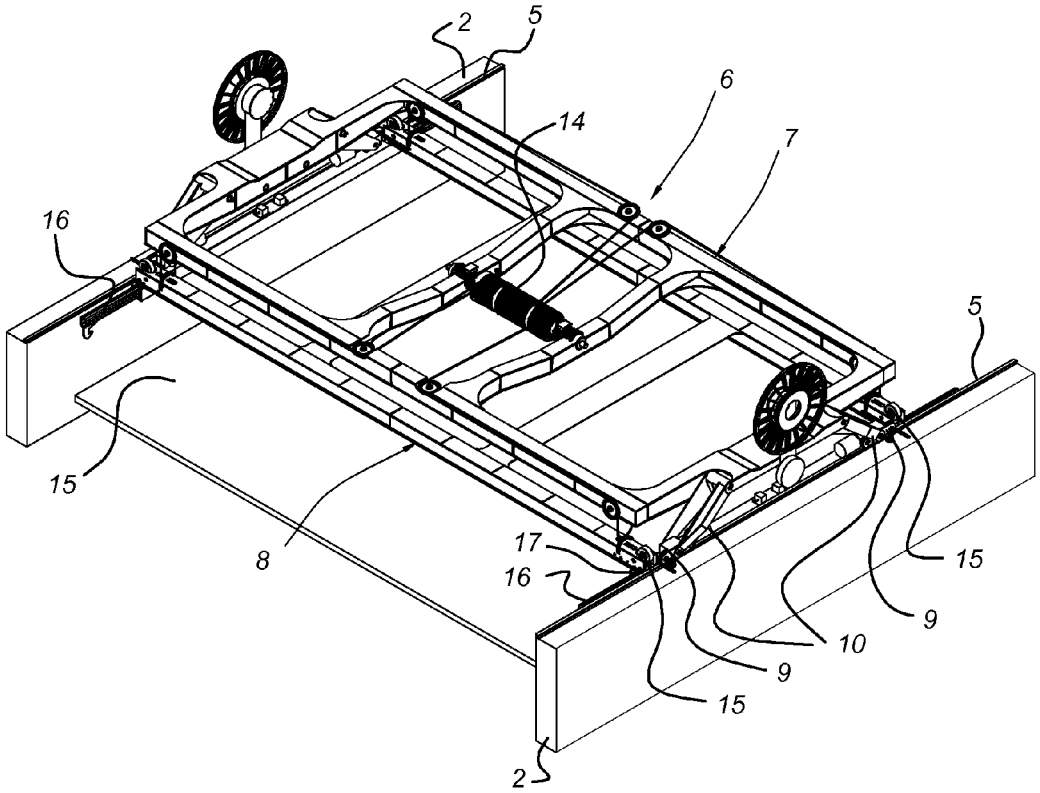

FIG. 4 shows the hold crane in perspective and in raised position.

Figure 5:
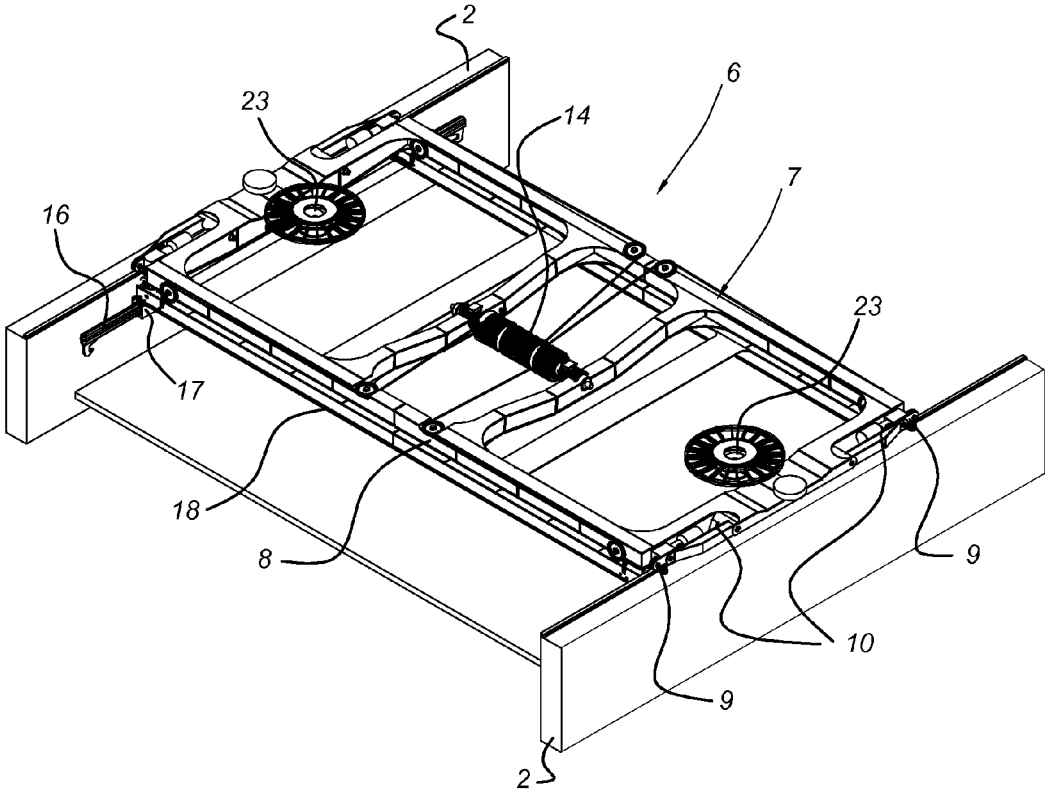

FIG. 5 shows the hold crane in perspective and in lowered position.

DETAILED DESCRIPTION OF THE INVENTION

The pipefeeder vessel 1 is shown in the figures only by its longitudinal side walls 2, as well as by the hold 3 which is defined between these side walls 2. The hold 2 furthermore has transversely extending end walls which are joined to opposite ends of the longitudinal side walls 2 as well as a bottom which is joined to the lower end of the walls. Within the hold, a number of pipes 4 is stacked as shown in FIG. 2. These pipes are oriented parallel to the longitudinal direction of the side walls 2 and of the hold 3 as a whole. Some of these pipes 4 have been indicated schematically in the figures; it is to be understood that the hold 3 can be filled with pipes up to the upper boundary thereof.

The top end of the longitudinal side walls 2 is bordered by hold crane support tracks 5 on top of which the hold crane 6 can be displaced according to the longitudinal direction of the hold 3. The hold crane consists, in the embodiment shown, of the main frame 7 and the auxiliary frame 8. The main frame 7 is equipped with wheels 9 which are rollable over the support tracks 5. The wheels are suspended on the lever arms 10, which are pivotally around hinge 11 and which can be swung by the actuator 12 between the active, relatively raised position as shown in FIGS. 1-4, and a relatively low, rest position as shown in FIG. 5. As a result of the relatively high active position, it is possible to fill the pipe hold 3 to its upper boundary while still maintaining the possibility to handle the pipes by the raised hold crane 6. In the rest position, the hold crane may be stored underneath a covering (not shown) of the hold 3 which is positioned over the hold when in transit.

The auxiliary frame 8 is suspended from the main frame 7 by cables 13. The cables are slung around the winch 14 which is carried by the main frame 7. By controlling the winch in the appropriate way, the auxiliary frame 8 can be lowered and raised as desired in the hold 3 for loading or unloading the pipes 4. As shown in the top view of FIG. 1, two pairs of cables 13 are arranged between the main frame 7 and the auxiliary frame 8. During these movements up and down, the auxiliary frame 8 is stabilized against unwanted transverse movements by the rollers 15 shown in greater detail in FIG. 2*a* which are carried by triangles 24 which are rotatably arranged at opposite ends (seen in cross section of the hold 3). The rollers 15 are held against the longitudinal side walls 2 of the hold 3 by means of actuators 22 (FIGS. 1 and 2) which are tilting the triangles 24 back and forth. By controlling the actuators 22, the rollers 15 can be moved back from the position shown in FIGS. 1 and 2, away from the longitudinal side walls 2 so as to allow longitudinal displacements of the main frame 8.

The auxiliary frame carries a number, in the embodiment shown two (although other numbers are possible as well), spreader beams 16, 16'. These spreader beams 16, 16' are hung from carriages 17 which are displaceable over support tracks 18 of the auxiliary frame 8. By means of electric motors 19, the carriages 17 can be driven along the support tracks 18 to any desired transverse position, dependent on the position of the pipe 4 to be picked up or to be deposited. Reels 23 are applied for winding or unwinding electric feed cables (not shown) connected to the electric motors. As shown in FIG. 5, these reels are collapsible so as to reduce the height of the hold crane during transport.

The spreader beams are equipped with hooks 20 at their opposite ends. As shown in FIGS. 1 and 3, these hooks can be moved towards each other (position shown with respect to spreader beam 16') and from each other (position shown with respect to spreader beam 16) by means of the actuators 21. After the spreader beams 16, 16' have been moved to the desired position as described before, the hooks are actuated so as to pick up or to deposit a pipe. During these processes, the spreader beams 16, 16' and therefore the pipes 4 supported thereby are in a well defined position. Such controlled handling of the pipes is not influenced by any motions of the pipefeeder vessel which may occur as a result of swaying motions caused by waves etc. Thus, the unloading of the pipes at sea can generally be carried out even under adverse weather conditions, which greatly enhances the operability of the pipelay vessel which receives the pipes in question.

LIST OF REFERENCE NUMERALS

1. Pipefeeder vessel
2. Side wall pipe hold
3. Pipe hold
4. Pipe
5. Hold crane support track
6. Hold crane
7. Main frame
8. Auxiliary frame
9. Main frame wheel
10. Lever arm
11. Pivot of lever arm
12. Lever arm actuator
13. Hoisting cables
14. Winch
15. Guide roller

16. Spreader beam
17. Carriage
18. Spreader beam support track
19. Electric motor
20. Hook
21. Hook actuator
22. Guide roller actuator
23. Reel
24. Triangle

The invention claimed is:

1. A pipefeeder vessel (1), comprising a hold (3) for containing pipes (4), said hold having opposite vertically oriented side walls (2), as well as a hold crane (6) comprising a main frame (7), displacement means (9-12) supporting the main frame above the hold (3) which is carried out for containing the elongate elements, said displacement means (9-12) allowing displacement of the main frame (7) in a longitudinal direction of the hold (3), and hoisting means (13, 14) carried by the main frame (7) for lifting an elongate element (4) from the hold (3) and vice versa, said hoisting means comprising at least two hoisting elements which are spaced apart in the longitudinal direction of the hold (3), said hoisting elements each being suspended from the main frame (7) and being provided coupling means for coupling onto an elongate element (4), and stabilizing means (8, 15) which cooperate with the hoisting elements and which allow vertical movement of said coupling means (20), wherein the hoisting elements comprise two pairs of hoisting cables (13), said two pairs of hoisting cables (13) being spaced in a transverse direction of the hold (3), the stabilizing means comprising an auxiliary frame (8) which is suspended below the main frame (7) by said two pairs of hoisting cables (13) and which is equipped with rollers (15) for guiding the auxiliary frame (8) in height direction, said rollers (15) being held against the vertically oriented side walls (2) of the hold (3) said auxiliary frame supporting the coupling means (20), wherein the coupling means (20) are located at opposite ends of at least one transversely displaceable spreader beam (16, 16'), said coupling means (20) being spaced apart in the longitudinal direction of the hold (3), said spreader beam being displaceably supported in the transverse direction of said hold (3) with respect to the auxiliary frame (8).

2. The pipefeeder vessel (1), according to claim 1, wherein the auxiliary frame (8) carries at least two of said spreader beam (16, 16') extending in the longitudinal direction of the hold (3), said spreader beam (16, 16') carrying the coupling means (20) which are located at the opposite ends of the spreader beam (16, 16').

3. The pipefeeder vessel (1), according to claim 2, wherein the auxiliary frame (8) carries transversely oriented support tracks (18) and the spreader beam (16, 16') has carriages (17) which are supported by said support tracks (18).

4. The pipefeeder vessel (1), according to claim 3, wherein the rollers (15) are arranged at opposite longitudinal sides of the auxiliary frame (8) for guiding said auxiliary frame in vertical direction with respect to both longitudinally extending side walls (2) of the hold (3).

5. The pipefeeder vessel (1), according to claim 4, wherein actuating means (22) are provided for displacing rollers (15) transversely with respect to the direction of displacement of the main frame (7) as allowed by the displacement means (9-12).

6. The pipefeeder vessel (1), according to claim 1, wherein the displacement means (9-12) provide for a height adjustment of the main frame (7).

7. The pipefeeder vessel (1), according to claim 1, wherein support tracks (5) are oriented according to the longitudinal direction of a pair of opposite side walls (2) of the pipe hold (3), the displacement means (9-12) of the hold crane (6) being displaceable along said support tracks (5).

8. The pipefeeder vessel (1) according to claim 7, wherein the support tracks (5) border the top of the side walls (2) of the hold (3), and the main frame (7) comprises rollers (9) which are displaceably supported with respect to the support tracks (5).

9. The pipefeeder vessel (1), according to claim 1, wherein,
the coupling means comprises a hook (20), and
the transversely oriented support tracks (18) comprise I-beams.

* * * * *